US007556182B2

(12) United States Patent
Murayama et al.

(10) Patent No.: US 7,556,182 B2
(45) Date of Patent: Jul. 7, 2009

(54) GAS COMBUSTION TYPE DRIVING TOOL

(75) Inventors: Katsuhiko Murayama, Tokyo (JP); Hajime Takemura, Tokyo (JP); Junichi Tamura, Tokyo (JP)

(73) Assignee: Max Co., Ltd., Tokyo (JP)

( * ) Notice: Subject to any disclaimer, the term of this patent is extended or adjusted under 35 U.S.C. 154(b) by 76 days.

(21) Appl. No.: 11/919,035

(22) PCT Filed: Apr. 28, 2006

(86) PCT No.: PCT/JP2006/309044

§ 371 (c)(1),
(2), (4) Date: Oct. 23, 2007

(87) PCT Pub. No.: WO2006/120947

PCT Pub. Date: Nov. 16, 2006

(65) Prior Publication Data

US 2009/0057365 A1 Mar. 5, 2009

(30) Foreign Application Priority Data

May 10, 2005 (JP) ..... 2005-137773

(51) Int. Cl.
*B27F 7/09* (2006.01)

(52) U.S. Cl. ..... 227/10; 227/130; 227/138

(58) Field of Classification Search ..... 227/8, 227/10, 120, 130, 138, 136, 112
See application file for complete search history.

(56) References Cited

U.S. PATENT DOCUMENTS 3,742,577 A * 7/1973 Buttriss ..... 29/811.2
4,313,552 A * 2/1982 Maurer ..... 227/109
5,558,264 A * 9/1996 Weinstein ..... 227/10
5,909,836 A * 6/1999 Shkolnikov et al. ..... 227/8
6,318,615 B1 * 11/2001 Walter ..... 227/10
6,796,476 B2 * 9/2004 Birk et al. ..... 227/2
6,994,240 B2 * 2/2006 Jakob et al. ..... 227/8
7,040,521 B2 * 5/2006 Kolodziej et al. ..... 227/10
7,137,186 B2 * 11/2006 Wojcicki et al. ..... 29/592
7,225,962 B2 * 6/2007 Porth et al. ..... 227/136
7,455,207 B2 * 11/2008 Wojcicki et al. ..... 227/120

FOREIGN PATENT DOCUMENTS

JP 49-6415 2/1974
JP 5-72380 10/1993
JP 8-252806 10/1996

* cited by examiner

*Primary Examiner*—Scott A. Smith
(74) *Attorney, Agent, or Firm*—Drinker Biddle & Reath LLP

(57) ABSTRACT

In a gas combustion type driving tool, on a feed cylinder 21 included in a feed piston/cylinder device 7, there is provided a spring for normally urging a feed piston 22 in a feed direction. A portion of the feed cylinder 21 opposite to the spring is connected to a combustion chamber 5 through a gas conduit 26. In an intermediate portion of the gas conduit 26, there is provided a delay piston/cylinder device A. One end of a delay cylinder 27 is disposed on the combustion chamber 5 side, while the other end thereof is disposed on the feed cylinder 21 side. When a delay piston 28 is slidingly moved from one end of the delay cylinder 27 to the other end thereof by the pressure of combustion gas, air compressed within the delay cylinder 27 is supplied from the other end of the delay cylinder 27 to the feed cylinder 21.

6 Claims, 12 Drawing Sheets

GAS COMBUSTION TYPE DRIVING TOOL

TECHNICAL FIELD

The present invention relates to a gas combustion type driving tool which comprises: a combustion chamber for explosively combusting a mixture gas produced by stirring and mixing together combustible gas and air; a drive piston/cylinder device which is driven by a combustion gas; a nose part for slidingly guiding a driver connected to the drive piston to thereby drive out a fastener therefrom; a feed piston/cylinder device for feeding the fastener to the nose part; and an operation delay device for delaying a retreat operation of a feed claw included in the feed piston/cylinder device.

BACKGROUND ART

As an example of a gas combustion type driving tool, there is known a combustion gas drive type driving tool in which combustible gas is charged into a combustion chamber formed in a hermetically closed manner within a tool body to stir up a mixed gas composed of combustible gas and air within the combustion chamber, a stirred mixed gas is combusted within the combustion chamber to thereby generate a high pressure combustion gas, and the high pressure combustion gas is applied to a striking piston accommodated within a striking cylinder to thereby impactively drive the striking piston within the striking cylinder, whereby a nail supplied to a nose part disposed in the lower portion of the tool body can be driven into steel or concrete by a driver connected to the lower surface side of the drive piston. (JP-A-08-252806) In such combustion gas type driving tool, not only a container such as a gas cylinder filled with combustible gas is mounted into the tool but also a battery functioning as a power supply for igniting the combustible gas is mounted on the tool, thereby forming the tool as a portable tool. Thus, this type of driving tool can carry out an operation to drive a nail or a pin without being restrained by a power supply source for supplying power, such as compressed air or the like.

In the above-mentioned gas combustion type driving tool, there is provided a feed device which sequentially feeds connected fasteners accommodated in a magazine into the nose part. As a feed device of this type, there is known a device structured such that connected fasteners, which are composed of a large number of fasteners connected together in a straight line, are accommodated in a sheath-shaped magazine, the connected fasteners are normally pressed toward the nose part by a spring having a constant output and, immediately after a fastener supplied to an eject opening formed in the nose part is driven, a next faster is supplied into the nose part.

However, in this straight-shaped magazine, since the number of fasteners to be accommodated therein is small, it has been requested to mount a cylindrical-shaped magazine which can store a large number of connected fasteners wound in a coil-like shape. Here, as a feed device used to feed the fasteners accommodated in the cylindrical-shaped magazine, generally, there is known a feed piston/cylinder device. This is a device in which, on a feed piston slidably accommodated in a feed cylinder, there is provided a feed claw engageable with and removable from the connected fasteners accommodated in the magazine, and the feed claw is reciprocated in a feed direction for feeding the feed claw toward the nose part side and in a retreat direction opposite to the feed direction.

Thus, it is possible to employ cylindrical-shaped magazine together with the previously described feed piston/cylinder device. In this case, it can be expected that the feed piston of the feed piston/cylinder device is made to reciprocate using a spring and the pressure of combustion gas in a combustion chamber. Referring further to the reciprocating operation, the feeding operation of the feed piston is executed by a spring, while the retreating operation of the feed piston is executed using the pressure of the combustion gas.

However, in a structure where a combustion chamber and a feed cylinder are directly connected to each other, as shown in FIG. 13, the combustion gas is applied to both of the striking piston and feed piston (feed claw) substantially at the same time; therefore, almost simultaneously with the striking operation of the striking piston, the feed piston is also retreated, thereby causing the fasters to be unstable in attitude when they are driven. In other words, since the feed piston is caused to remain at a feed position due to the spring and the leading one of the fastener supplied into the nose part is thereby pressed by the feed claw, the leading faster is stabilized in attitude. While the fasteners are being driven out by a driver, preferably, the attitudes of the fasteners may be stable. However, when a striking device is actuated due to the pressure of the combustion gas and thus the driver is driven together with a striking piston whereby the faster is driven and the piston is retreated simultaneously, a force for pressing and holding the fastener is lost to thereby cause the faster to be unstable in attitude, which makes it impossible to positively drive the fastener in its proper attitude.

In view of this, as means for delaying the operation timing of the striking piston of the striking device, there is known a technology in which, by taking out the combustion gas from the striking cylinder at a position slightly lower than the top dead center of the striking piston, the operation timing of the striking piston is delayed.

However, at the position slightly lower than the top dead center of the striking piston, the pressure of the combustion gas is reduced slightly, which in turn reduces the pressure to be applied to the feed cylinder of the feed device. This makes it necessary to increase the quantity of gas to be supplied into the feed cylinder, which also results in the increased size of the feed device.

DISCLOSURE OF THE INVENTION

One or more embodiments of the invention provides a gas combustion type driving tool which not only can supply sufficiently high pressure to a feed piston/cylinder device functioning as a fastener feed device but also can delay the retreat operation of a feed piston included in the feed piston/cylinder device.

According to one or more embodiments of the invention, a gas combustion type driving tool is provided with: a combustion chamber for explosively combusting a mixed gas produced by stirring and mixing combustible gas and air; a nose part for applying the thus produced high pressure combustion gas to a striking piston accommodated within a striking cylinder to impactively drive the striking piston within the striking cylinder to thereby slide and guide a driver connected to the lower surface side of the striking piston so as to drive out a fastener therefrom; a feed piston/cylinder device for reciprocating a feed claw engageable with and removable from connected fasteners accommodated in a magazine in a feed direction to feed it toward the nose part and in a retreat direction opposite to the feed direction; a spring disposed on the feed cylinder of the feed piston/cylinder device for normally urging a feed piston including the above-mentioned feed claw in the feed direction; a gas conduit interposed between the above combustion chamber and the above feed piston/cylinder; and an operation delay device disposed in the gas conduit for actuating the feed piston of the feed piston/ cylinder device against the above spring in such a manner that it is delayed with respect to the operation of the striking piston caused by the combustion of the mixed gas within the combustion chamber.

According to one or more embodiments of the invention, the operation delay device may also include a delay cylinder which is disposed in the intermediate portion of the gas, while one end of the delay cylinder is opened to the combustion chamber with the other end thereof opened to the feed cylinder. When a delay piston slidable within the delay cylinder due to the pressure of the combustion gas is slid from one end of the delay cylinder to the other end thereof due to the pressure of the combustion gas, air compressed within the delay cylinder is supplied from the other end of the delay cylinder to the feed cylinder. Also, according to one or more embodiments of the invention, the operation delay device may also include a gas storing space portion or a drawing portion which is formed in the gas conduit and is used to delay the supply of the combustion gas from the combustion chamber to the feed cylinder.

Also, according to one or more embodiments of the invention, the operation delay device may also contain a timing valve device disposed in the intermediate portion of the gas conduit and including a valve member, in which, when the valve member is present in one end of the operation delay device, it closes the gas conduit and, when the valve member is moved to the other end of the operation delay device due to the pressure of the combustion gas, it opens the gas conduit.

According to one or more embodiments of the invention, in the gas combustion type driving tool, there is interposed a gas conduit between the combustion chamber and feed piston/cylinder device and, in the gas conduit, there is disposed the operation delay device for actuating the feed piston of the feed piston/cylinder device against the above-mentioned spring in such a manner that such actuation is delayed with respect to the operation of the striking piston caused by the combustion of the mixed gas within the combustion chamber. Owing to this, with the combustion of the mixed gas within the combustion chamber, the striking piston is operated for striking and the feed piston is operated for retreating in such a manner that the operation of the feed piston is delayed with respect to the striking operation of the striking piston: that is, until the leading nail within the nose part is struck by the driver and driven out from the nose part by the striking operation of the striking piston, the feed piston is not operated for retreating. Therefore, when the leading nail is driven out from the nose part, it is pressed against the inner surface of the nose part and is thus stable in attitude. Thus, the leading nail can be driven out properly.

Also, since the pressure of the combustion gas combusted within the combustion chamber (in the upper portion of the striking piston) is fed from the gas conduit to the feed piston/cylinder device, a sufficiently high pressure can be supplied to the feed piston/cylinder device. Further, in a structure where, in the intermediate portion of the gas conduit, there is disposed a delay cylinder having one end opened to the combustion chamber with the other end opened to the feed cylinder and, when a delay piston slidable within the delay cylinder due to the pressure of the combustion gas is slid from the above-mentioned one end of the delay cylinder to the other end thereof, air compressed within the delay cylinder is supplied from the other end of the other end of the delay cylinder to the feed cylinder, the supply of the gas pressure on the combustion chamber side can be delayed by the time necessary for the pressure of the air, which is compressed when the delay piston slides from one end to the other end of the delay cylinder, to rise so sufficiently as to be able to retreat the feed piston.

Also, in a structure where, in the gas conduit, there is formed a gas storing space portion or a drawing portion for delaying the gas supply from the combustion chamber to the feed cylinder, since the supply speed of the gas pressure on the combustion chamber side is slowed down in the gas storing space portion or drawing portion, the retreat operation of the feed piston can be delayed by the time necessary for the air pressure to rise so sufficiently as to be able to retreat the feed piston.

And, in a structure where, in the intermediate portion of the gas conduit, there is disposed a timing valve device including a valve member which, when the valve member is present in one end of the timing valve device, closes the gas conduit connecting together the combustion chamber and feed cylinder and, when the valve member is moved to the other end of the timing valve device due to the pressure of the combustion gas, opens the gas conduit, even when the mixed gas is burned within the combustion chamber, during the time while the valve member is moving from its top dead center position to the gas conduit opening position, the gas conduit remains closed and thus the pressure of the combustion gas is not supplied to the delay cylinder. Therefore, according to this structure, the retreat operation of the feed piston can be delayed by the time sufficient to retreat the feed piston.

Other aspects and advantages of the invention will be apparent from the following description and the appended claims.

DESCRIPTION OF REFERENCE NUMERALS AND SIGNS

Figure 1:
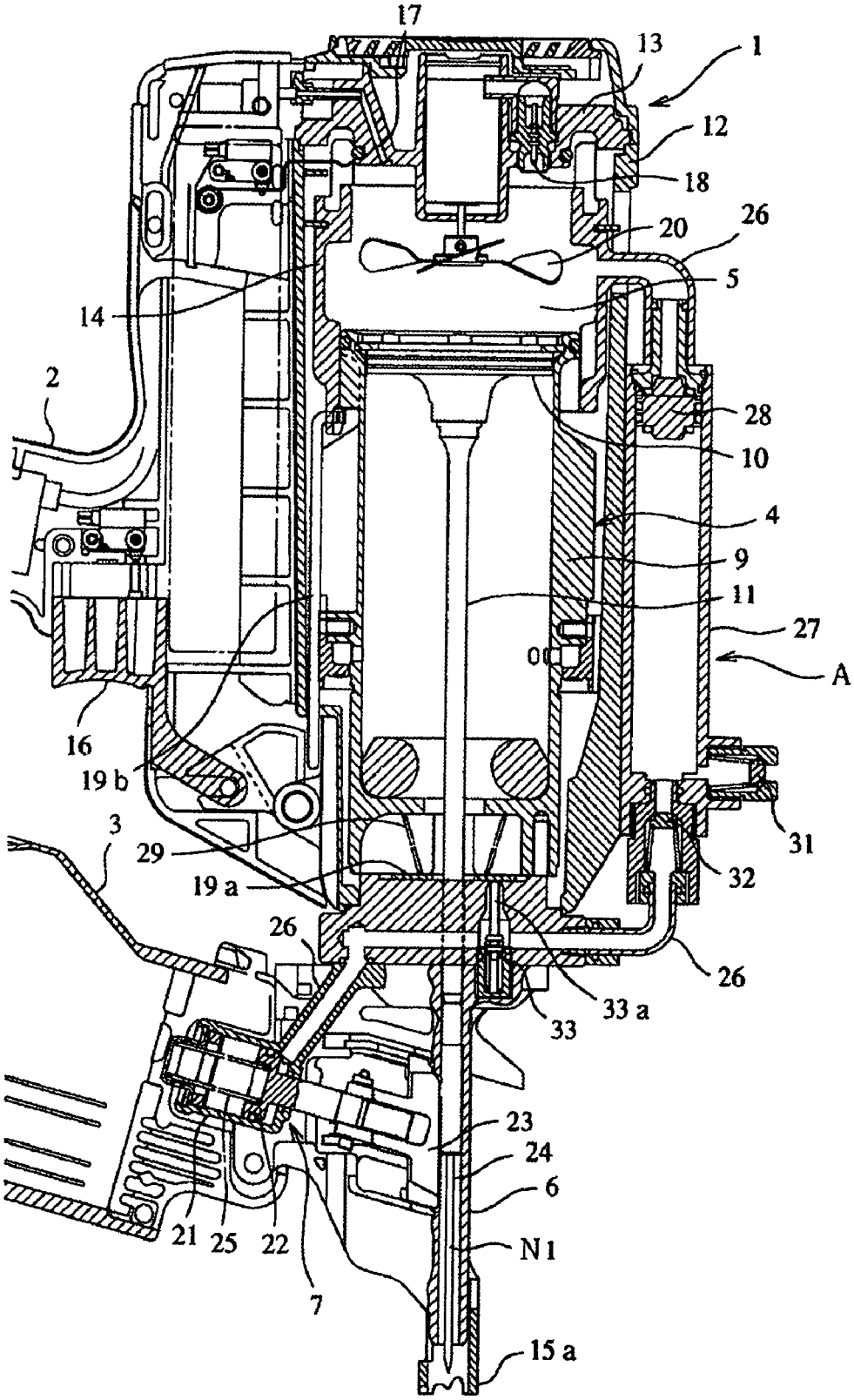
FIG. 1 is a longitudinal section view of the main portions of a gas combustion type nail driving tool, showing a state in which the driving tool is not in operation.

A: Delay piston/cylinder device
B: Delay chamber device
C: Timing valve device for delay
5: Combustion chamber
7: Feed piston/cylinder device
26: Gas conduit
28: Delay piston
35: Gas storing space portion
41: Valve member

BEST MODE FOR CARRYING OUT THE INVENTION

Now, description will be given below of exemplary embodiments according to the invention with reference to the accompanying drawings.

Here, a driving tool according to the invention is not limited to a nail driving tool. That is, the invention can be applied to a driving tool which feeds connected fasteners such as headed bar members (nails or screws) and headless bar members (parallel pins) while transmitting power using the combustion of a mixed gas.

In FIG. 1, reference numeral 1 designates the body of a gas combustion type nail driving tool. To the body 1, there are connected a grip 2 and a magazine 3; and, on the body 1, there are provided a striking piston/cylinder device 4, a combustion chamber 5, a nose part 6, and a feed piston/cylinder device 7 for nail feeding.

The striking piston/cylinder device 4 is structured such that a striking piston 10 is slidably accommodated within a striking cylinder 9 and a driver 11 is connected to the lower portion of the striking piston 10 integrally therewith.

The combustion chamber 5 is defined by the upper end face of the striking piston 10, an upper wall (a cylinder head) 13 formed within the striking cylinder 9 and an upper housing 12, and a ring-shaped movable sleeve 14 interposed between the upper end face of the striking piston 10 and upper wall 13. And, when the movable sleeve 14 is moved upward, there is formed the closed combustion chamber 5; and, when the movable sleeve 14 is moved downward, the upper portion of the combustion chamber 5 is allowed to communicate with the atmosphere.

Figure 2:
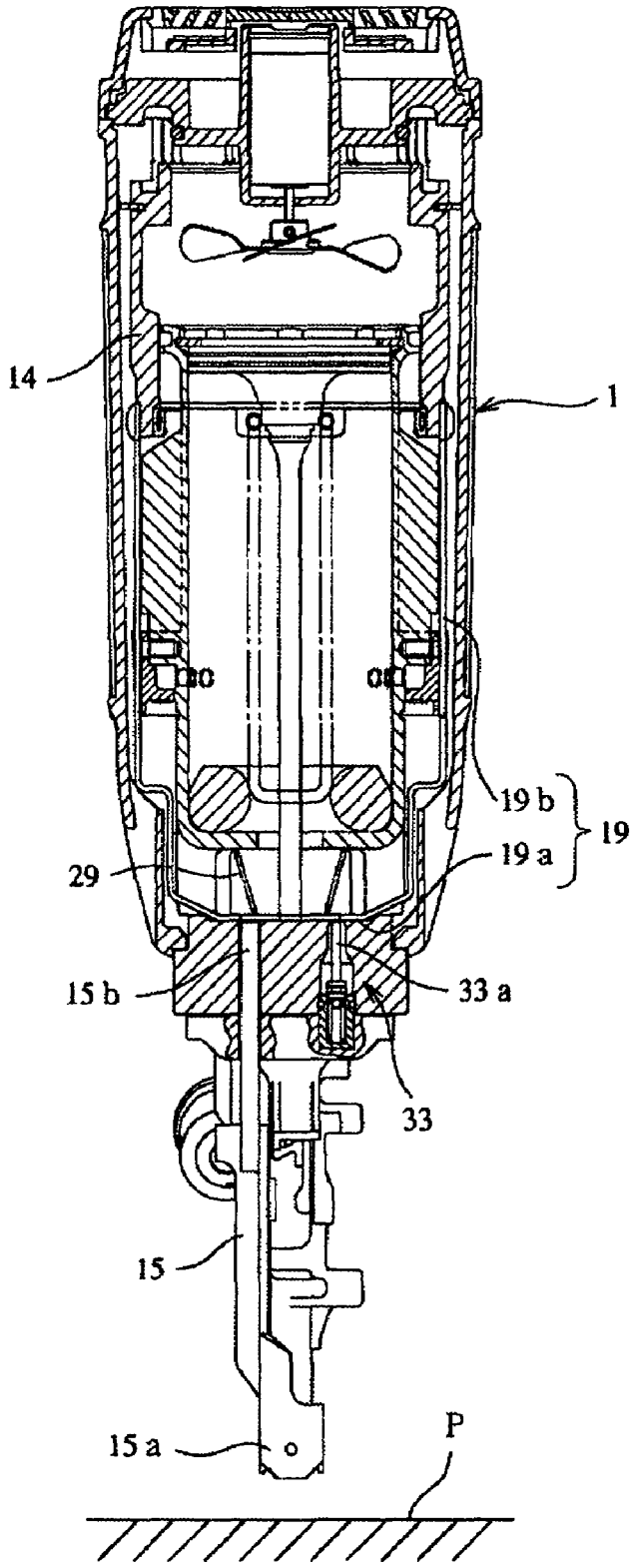
FIG. 2 is a front view of the main portions of a nail driving tool, showing a state how a contact arm and a link member are mounted.

That is, the movable sleeve 14, as shown in FIG. 2, is linked through a link member 19 with a contact arm 15. The link member 19 is structured such that it includes a basket-shaped bottom portion 19*a* disposed downwardly of the striking cylinder 9 and an arm portion 19*b* extending along the outer peripheral portion of the striking cylinder 9 from the end portion of the basket-shaped bottom portion 19*a*. The upper end of the arm portion 19*b* is connected to the movable sleeve 14, while the basket-shaped bottom portion 19*a* is energized downward by a spring 29 which is interposed between the lower surface of the striking cylinder 9 and basket-shaped bottom portion 19*a*. Also, the contact arm 15 is disposed such that it can be slidingly moved in the vertical direction along the nose part 6. And, the lower end 15*a* of the contact arm 15 is projected from the nose part 6 and, when the lower end 15*a* is pressed together with the nose part 6 against a member to be nail-driven P, the lower end 15*a* can be moved upward with respect to the nose part 6 (see FIG. 3). And, the lower surface of the basket-shaped bottom portion 19*a* of the link member 19 is engaged with the upper end 15*b* of the contact arm 15. Therefore, by pressing the nose part 6 against the member to be nail-driven P, the contact arm 15 is moved upward with respect to the nose part 6 to push up the link member 19 against the urging force of the spring 29, so that the movable sleeve 14 is moved upward. This forms the closed combustion chamber 5. On the other hand, by detaching the nose part 6 from the member to be nail-driven P, the contact arm 15 is relatively moved downward, and the link member 19 and movable sleeve 14 are respectively moved downward by the urging force of the spring 29, thereby opening the combustion chamber 5 to the atmosphere.

Figure 3:
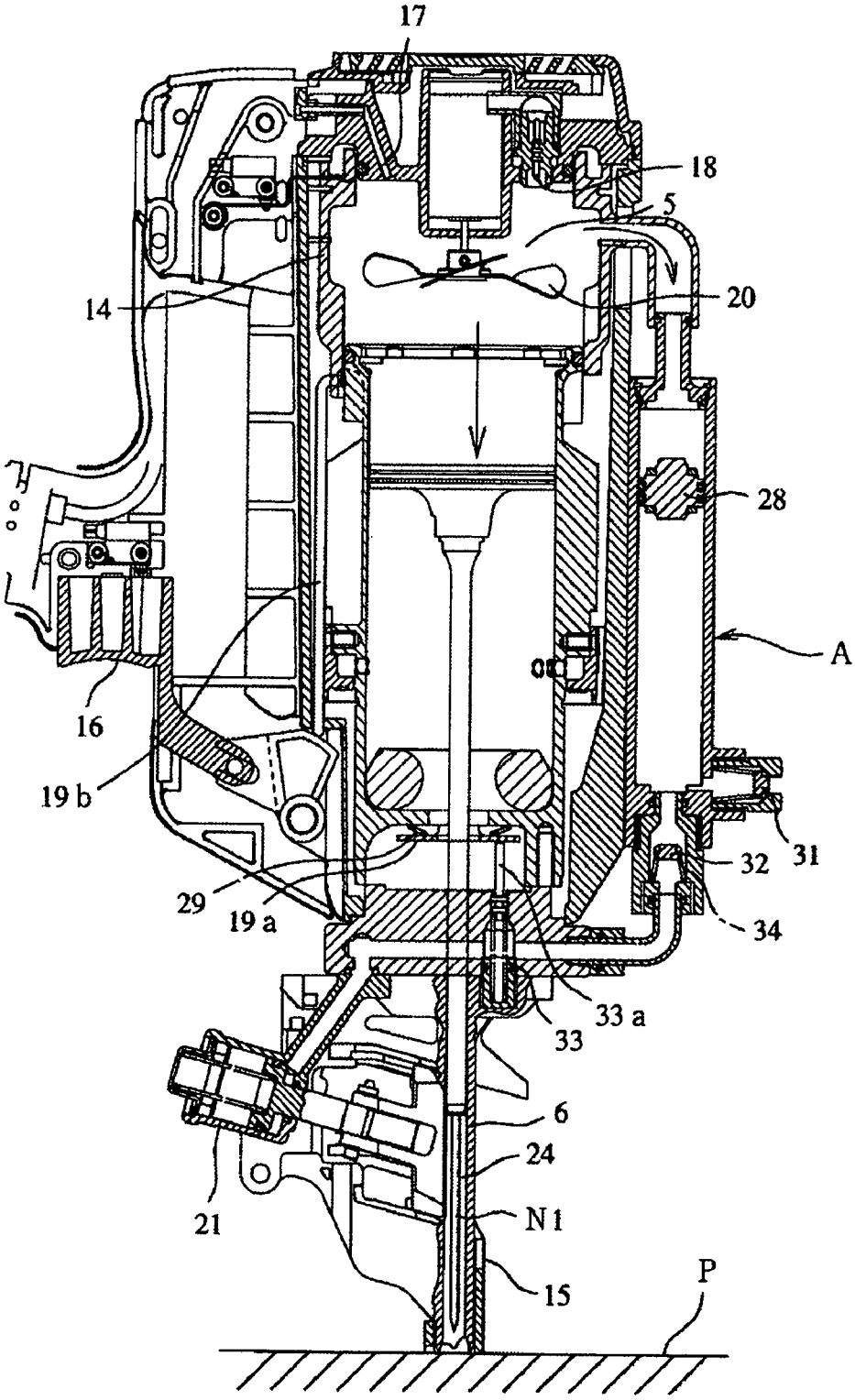
FIG. 3 is a longitudinal section view of the nail driving tool, showing a state where its nail driving operation is started.
Figure 4:
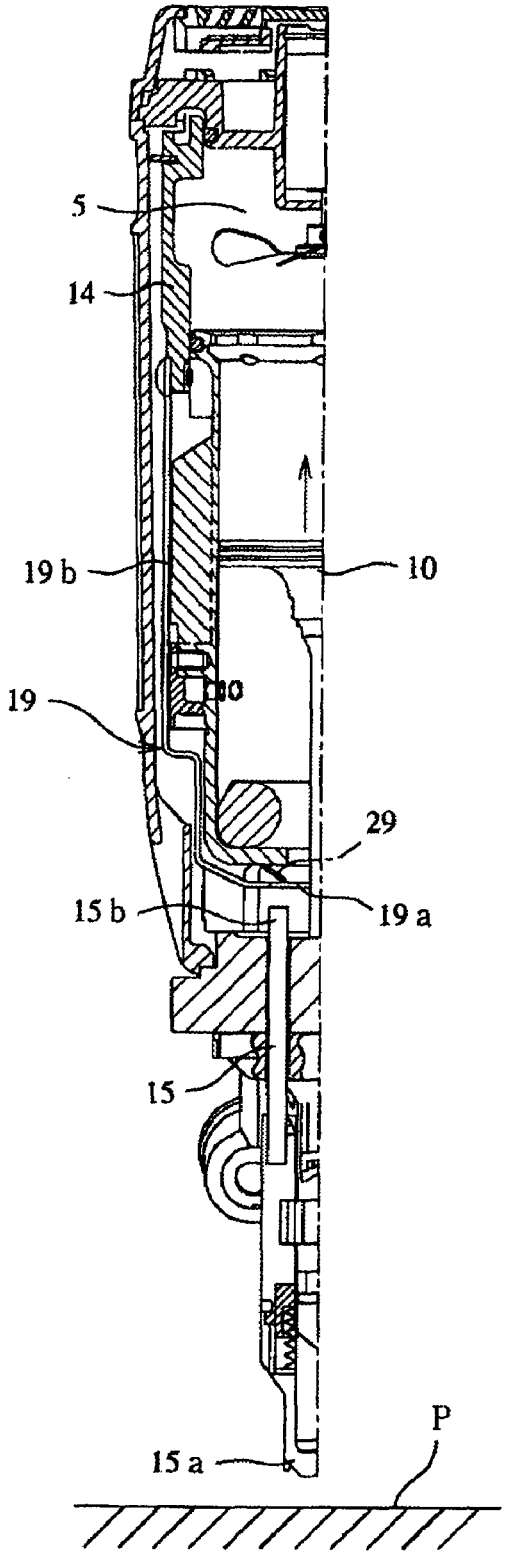
FIG. 4 is a longitudinal section view of the nail driving tool, showing a state just after end of the nail driving operation.

As described above, when actuating the nail driving tool, the movable sleeve 14 is relatively moved up to an upper position shown in FIG. 3 in linking with the operation to press the contact arm 15 against the member to be nail-driven P, thereby shutting out the inside of the combustion chamber 5 from the atmosphere. On the other hand, when the nail driving tool is lifted upward due to the reaction caused just after execution of a nail driving operation, the contact arm 15, as shown in FIG. 4, moves downward along the nose part 6 due to its own dead weight. At the then time, as will be discussed later, the pressure of the inside of the combustion chamber 5 is held negative just after execution of the nail driving operation, whereas the movable sleeve 14 (and link member 19) is held at the same position. As a result of this, the contact arm 15 and the basket-shaped portion 19*a* of the link member 19 are detached from each other. After then, when the striking piston 10 rises up to its initial position and the combustion chamber 5 is thereby opened to the atmoshpere, the movable sleeve 14 and link member 19 are respectively moved downward due to the urging force of the spring 29, so that they are engaged again with the contact arm 15 to thereby form an integral body.

In the upper housing 12, there are provided an injection nozzle 17 in communication with a gas container, and an ignition plug 18 which ignites a mixed gas into combustion. Also, in the upper housing 12, there is arranged a rotary fan 20 which is used to stir up combustible gas injected into the combustion chamber 5 together with the air within the combustion chamber 5 to thereby generate a mixed gas having a given air fuel ratio within the combustion chamber 5.

The nose part 6 guides the sliding movement of the driver 11 and also opens to the magazine 3.

Figure 5A:
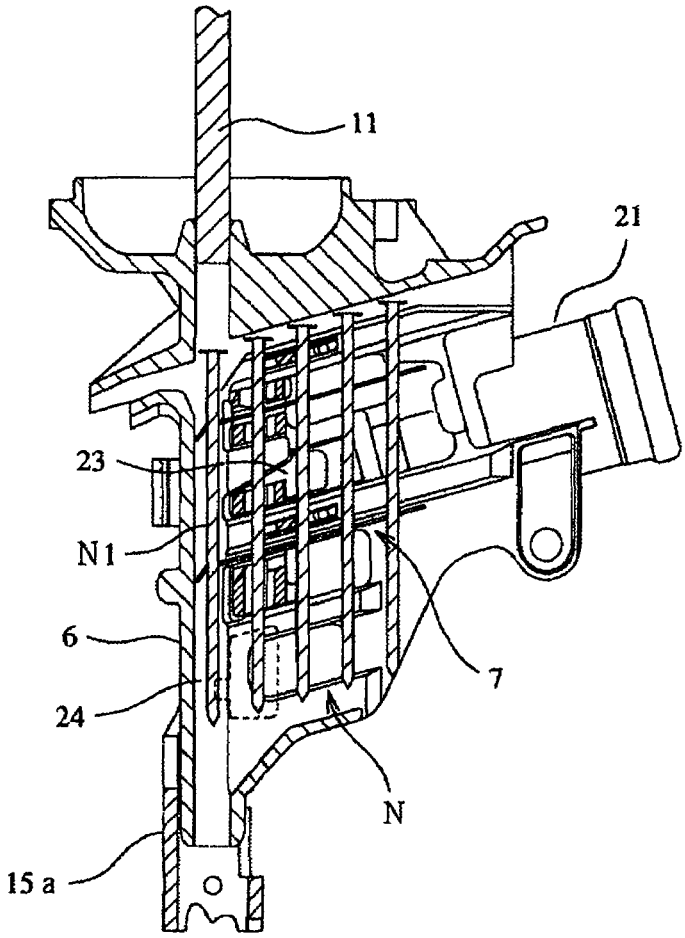
FIG. 5A is a longitudinal section view of the nail driving tool when viewed from behind, showing the nail feeding state of a nail feed claw.
Figure 5B:
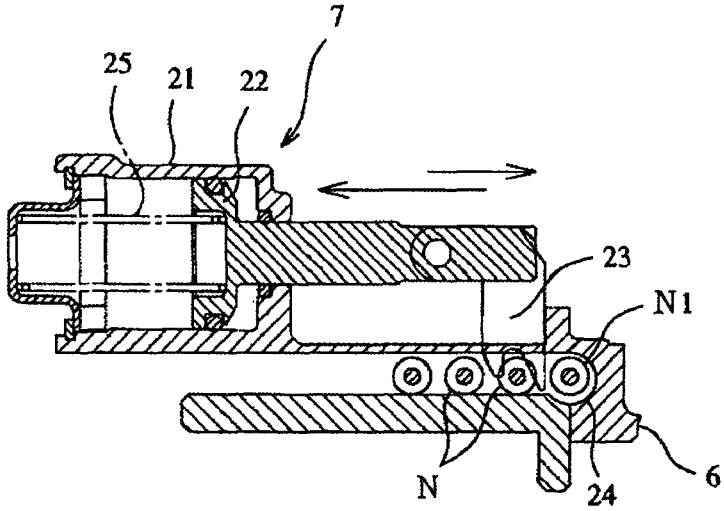
FIG. 5B is an explanatory view of a nail feed piston/cylinder device and a nail feed claw.

The feed piston/cylinder device 7 is structured such that, as shown in FIGS. 5A and 5B, to a feed piston 22 slidably accommodated within a feed cylinder 21, there is connected a feed claw 23, and the feed claw 23 together with the feed piston 22 is engaged with and disengaged from connected nails N accommodated in the magazine 3 to thereby reciprocate the feed claw 23 and feed piston 22 in a nail feed direction to feed the connected nails N toward the nose part 6 and in a retreat direction opposite to the nail feed direction. When the feed piston 22 is moved to its moving end in the feed direction, the leading nail N1 of the connected nails N is pushed into an eject opening 24 formed in the nose part 6. Therefore, in a state where the feed piston 22 is present at its moving end position in the feed direction, the connected nails N also remain unmoved, whereby the leading nail N1 is held within the eject opening 24.

Next, on the feed cylinder 21 of the feed piston/cylinder device 7, there is provided a spring 25 which normally energizes the feed piston 22 in the feed direction. On the other hand, the portion of the feed cylinder 21 on the opposite side of the spring 25 is connected through a gas conduit 26 to the combustion chamber 5. And, in the intermediate portion of the gas conduit 26, there is provided a delay piston/cylinder device A functioning as a delay device in which a delay piston 28 is slidably accommodated within a delay cylinder 27.

The delay cylinder 27 is disposed such that its upper end is open to the combustion chamber 5 and its lower end is open to the feed cylinder 21. When the delay piston 28 is slidingly moved from the upper end of the delay cylinder 27 to the lower end thereof due to the pressure of the combustion gas, the air is compressed within the delay cylinder 27; and, the pressure of the compressed air is supplied from the lower end of the delay cylinder 27 to the feed cylinder 21.

Also, on the lower end side portion of the delay cylinder 27, there is disposed a first check valve 31 which is used to take in the air from the atmosphere; and, downwardly of the delay cylinder 27, there is disposed a second check valve 32. In the intermediate portion of the gas conduit 26, between the second check valve 32 and feed cylinder 21, there is interposed a switch valve 33 which can be actuated in linking with the operation of the link member 19. Specifically, normally, the valve stem 33*a* of the switch valve 33, as shown in FIG. 1, is pressed into the bottom portion 19*a* (for details, see FIG. 3) of the link member 19 and is thereby held at a position to open the gas conduit 26 to the atmosphere; whereas, in the nail driving operation, as shown in FIG. 3, when the leading end of the nose part 6 is pressed against the member to be nail-driven P to move the contact arm 15 upward with respect to the nail driving tool, the bottom portion 19*a* is pushed and moved upward against the urging force of the spring 29 and, in linking with the upward movement of the bottom portion 19*a*, the valve stem 33*a* is moved to a position where it shuts off the gas conduit 26 and the atmosphere from each other.

Figure 6:
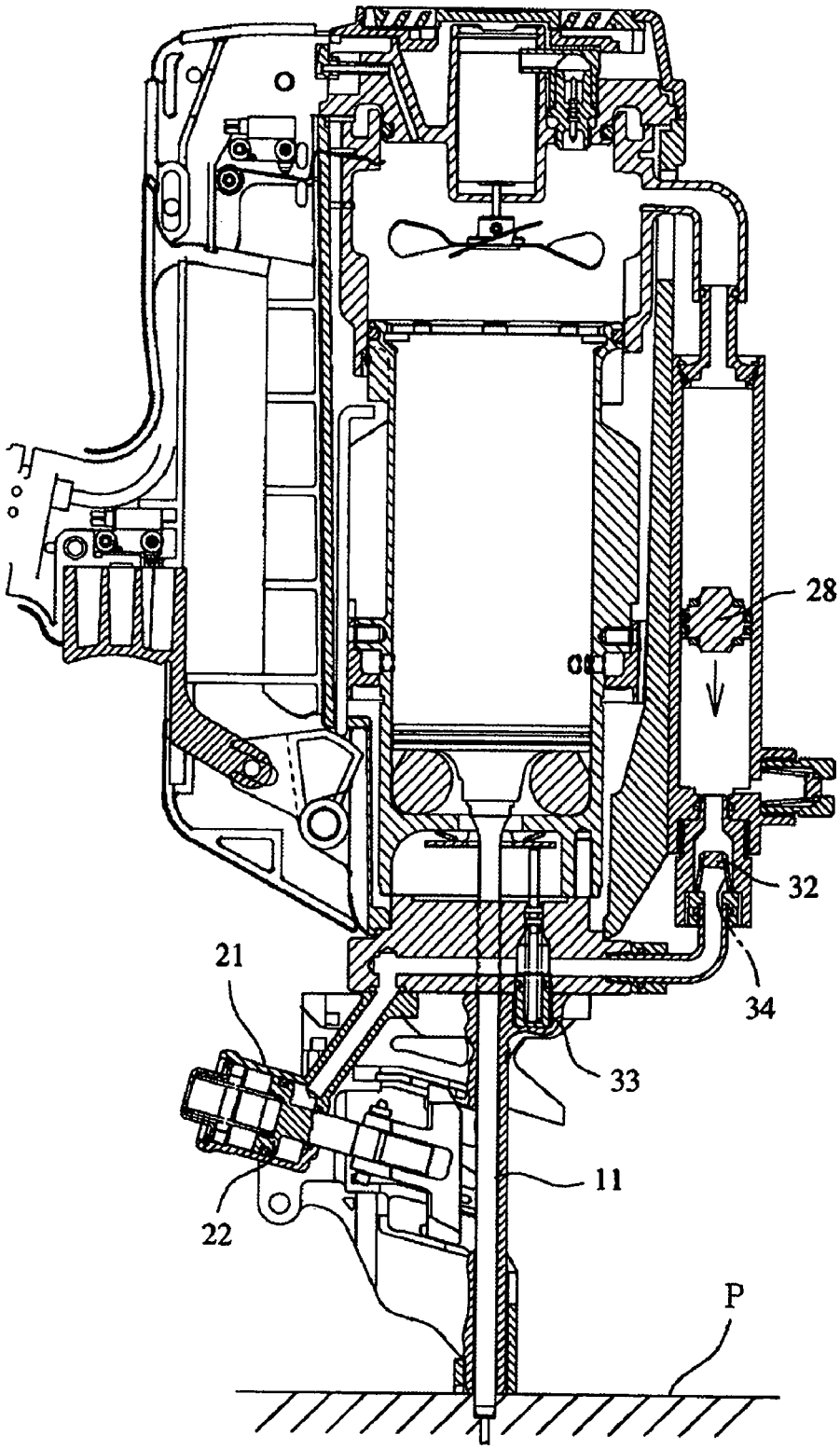
FIG. 6 is a longitudinal section view of a delay piston/cylinder device, showing the retreat starting state of a nail feed piston including in the delay piston/cylinder device.

Next, description will be given below of the operation of the above-mentioned operation delay device. Firstly, in the nail driving operation, as shown in FIGS. 3 and 6, when the nose part 6 is strongly pressed against the member to be nail-driven P to thereby move the contact arm 15 upward with respect to the nail driving tool, not only the movable sleeve 14 is moved upward to thereby form the closed combustion chamber 5 but also the combustible gas is injected from the injection nozzle 17 into the combustion chamber 5 and the rotary fan 20 is rotated to stir and mix together the combustible gas and the air. Also, with the upward movement of the contact arm 15, the switch valve 33 shuts off the gas conduit 26 from the atmosphere. Next, when the trigger 16 is pulled, the ignition plug 18 ignites the mixed gas, with the result that the mixed gas is burned and is thereby expanded explosively. The pressure of the combustion gas acts onto the upper surface of the striking piston 10 to thereby drive the striking piston 10 downward, with the result that the driver 11 strikes the leading nail N1 supplied into the eject opening 24 of the nose part 6 to thereby drive it into the member to be nail-driven P.

At the same time, since the pressure of the combustion gas within the combustion chamber 5 acts from the gas conduit 26 also onto the upper surface of the delay piston 28 of the delay piston/cylinder device A constituting the operation delay device, the delay piston 28 is also slidingly moved from the upper end of the delay cylinder 27 down to the lower end thereof. At the then time, because, into the delay cylinder 27, there has already been taken the air from the atmosphere through the first check valve 31, and also because the second check valve 32 is disposed downwardly of the delay cylinder 27, the above-mentioned air is compressed due to the downward sliding movement of the delay piston 28. And, when the pressure of the compressed air rises up to a given pressure, the compressed air is supplied from the lower end of the delay cylinder 27 to the feed cylinder 21 against the urging force of the spring 34 of the second check valve 32, with the result that the feed piston 22 is moved in the retreat direction.

In this manner, the supply of the pressure of the combustion gas from the combustion chamber 5 to the feed cylinder 21, when the delay piston 28 is slidingly moved from the upper end of the delay cylinder 27 down to the lower end thereof, can delay the above-mentioned retreat operation by the time necessary for the pressure of the air compressed within the delay cylinder 27 to rise so sufficiently as to retreat the feed piston 22.

Figure 7:
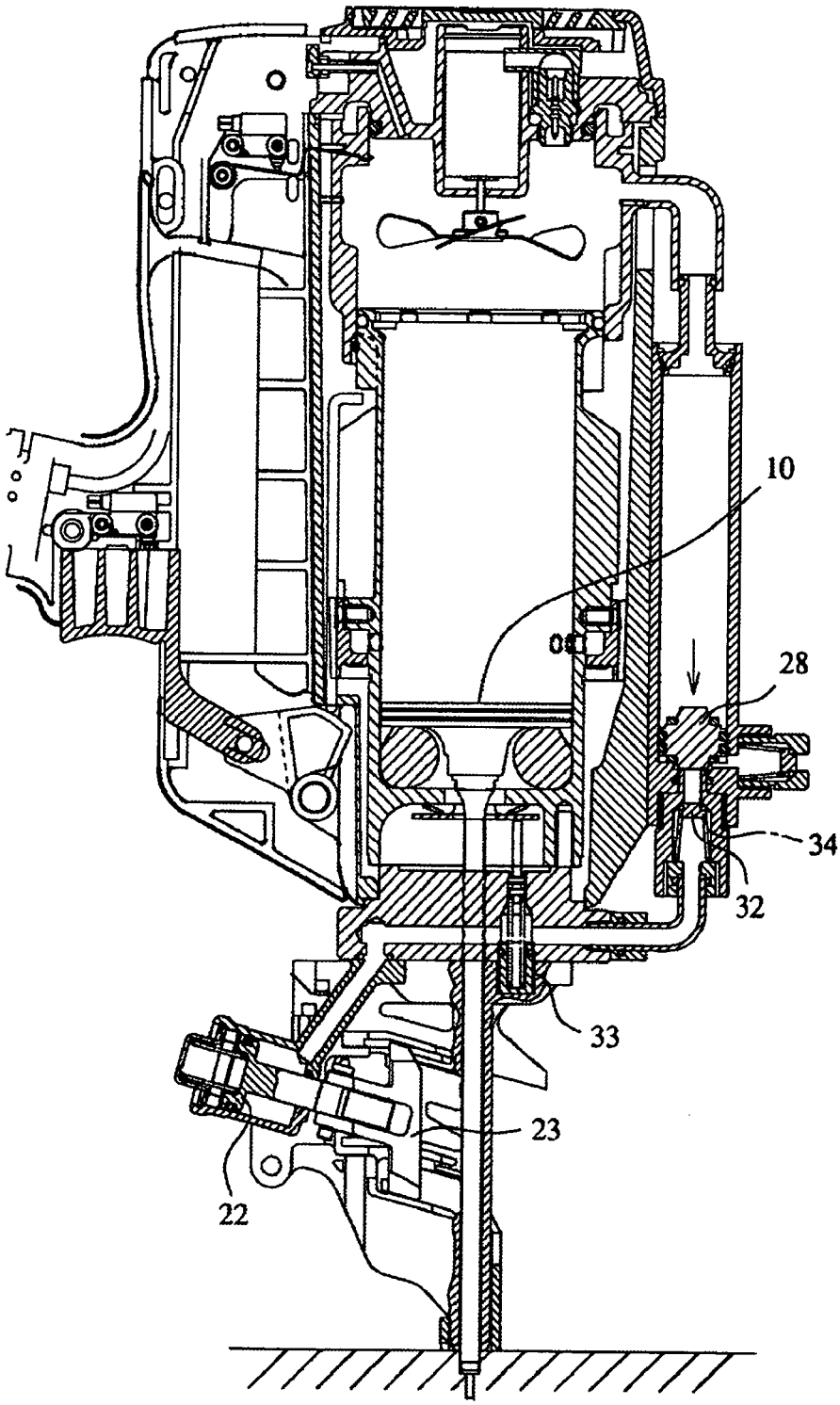
FIG. 7 is a longitudinal section view of the delay piston/cylinder device, showing the retreat state of the nail feed piston of the delay piston/cylinder device.

As described above, after the striking piston 10 actuates its striking operation with the combustion of the combustion gas in the combustion chamber 5, the feed piston 22 is caused to retreat. Specifically, as shown in FIG. 6, since the feed claw 23 of the feed piston 22 remains unmoved until the leading nail held within the nose part 6 is struck and driven out from the nose part 6 by the driver 11 due to the striking operation of the striking piston 10, the leading nail is retained by the inner wall of the eject opening 24 of the nose part 6 and is thereby held stable in attitude. Therefore, the leading nail can be driven out properly. After then, as shown in FIG. 7, when the delay piston 28 arrives at its bottom dead center, the feed piston 22 returns to its initial position.

Figure 12:
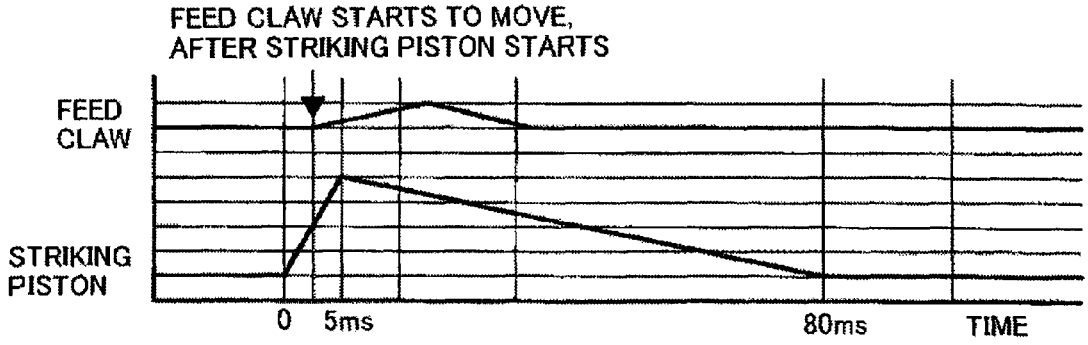
FIG. 12 is a timing chart, showing a difference between the timings of a feed claw and a striking piston when a delay operation device is provided.
Figure 13:
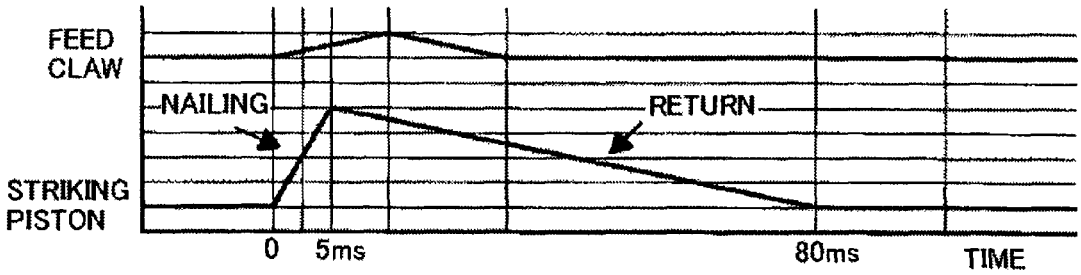
FIG. 13 is a timing chart, showing a difference between the timings a feed claw and striking piston when a combustion chamber and a feed cylinder are directly coupled to each other.

By the way, FIG. 12 shows a difference in the operation timing between the striking piston and feed claw (feed piston) in the nail driving operation.

Figure 8:
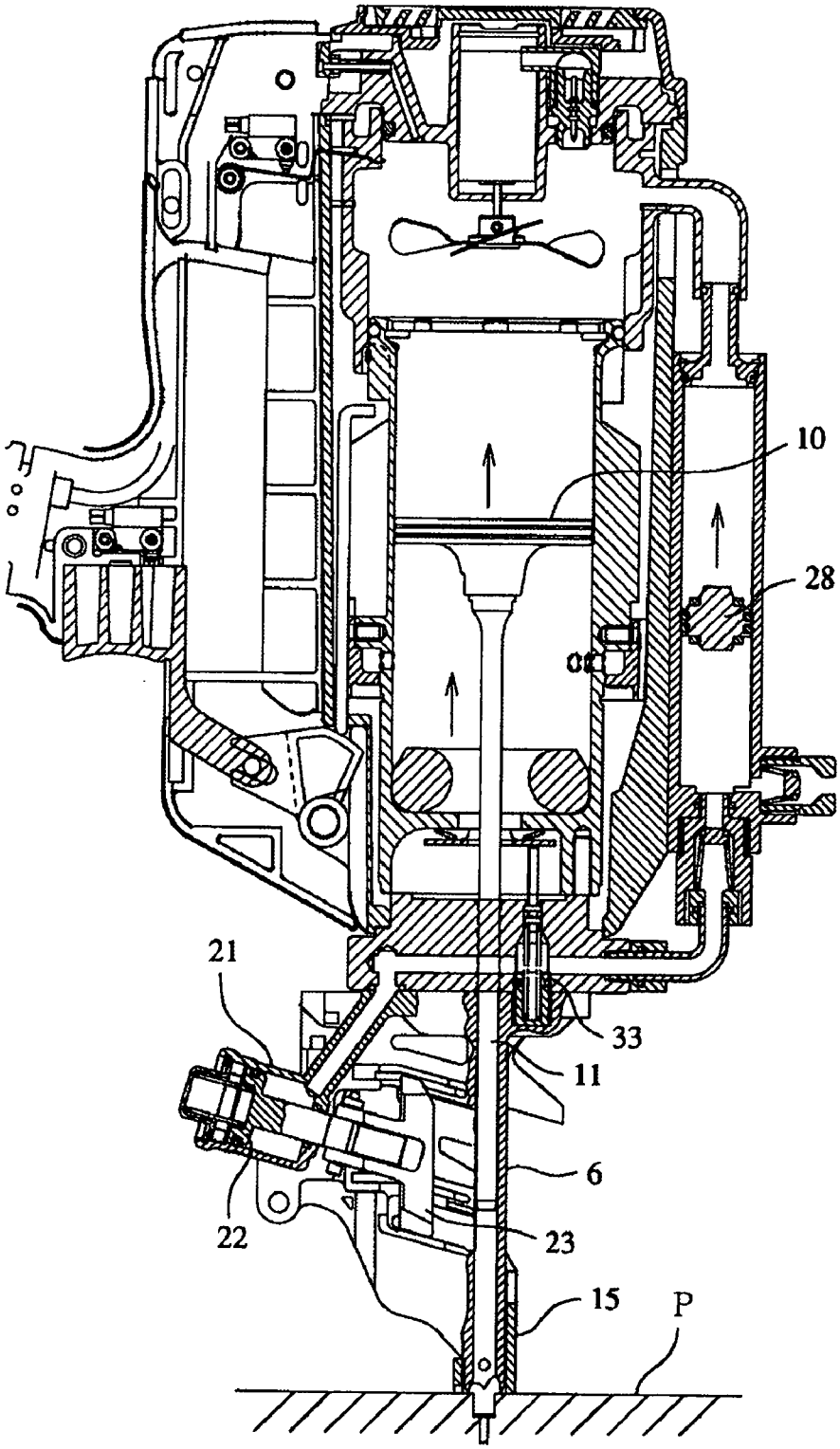
FIG. 8 is a longitudinal section view of a striking piston, showing the returning state thereof.

When the nail driving operation is completed, since the temperature within the combustion chamber 5 lowers suddenly, a space existing upwardly of the striking piston 10 expanded to the striking cylinder 9 becomes negative in pressure and is going to return to its initial capacity due to a difference between such negative pressure and the atmospheric pressure coming from below; and, therefore, as shown in FIGS. 4 and 8, the striking piston 10 moves or returns to its top dead center. Similarly, the delay piston 28 also returns to its top dead center. On the other hand, when the combustion chamber 5 is opened, the basket-shaped bottom portion 19*a* is moved downward due to the urging force of the spring 29 to push down the switch valve 33, whereby the switch valve 33 opens the gas conduit 26 to the atmosphere, the compressed air is discharged from the feed cylinder 21 through the switch valve 33 to the atmosphere to thereby reduce the pressure of the feed cylinder 21; and thus, the feed piston 22, as shown in FIGS. 5A and 5B, is moved in the nail feed direction due to the urging force of the spring 26, with the result that a new leading nail is supplied into the nose part 6.

By the way, from the gas conduit to the feed piston/cylinder device, there is supplied the pressure of the combustion gas burned in the combustion chamber (in the upper portion of the striking piston). That is, a sufficiently high level of pressure can be supplied to the feed piston/cylinder device.

Figure 9:
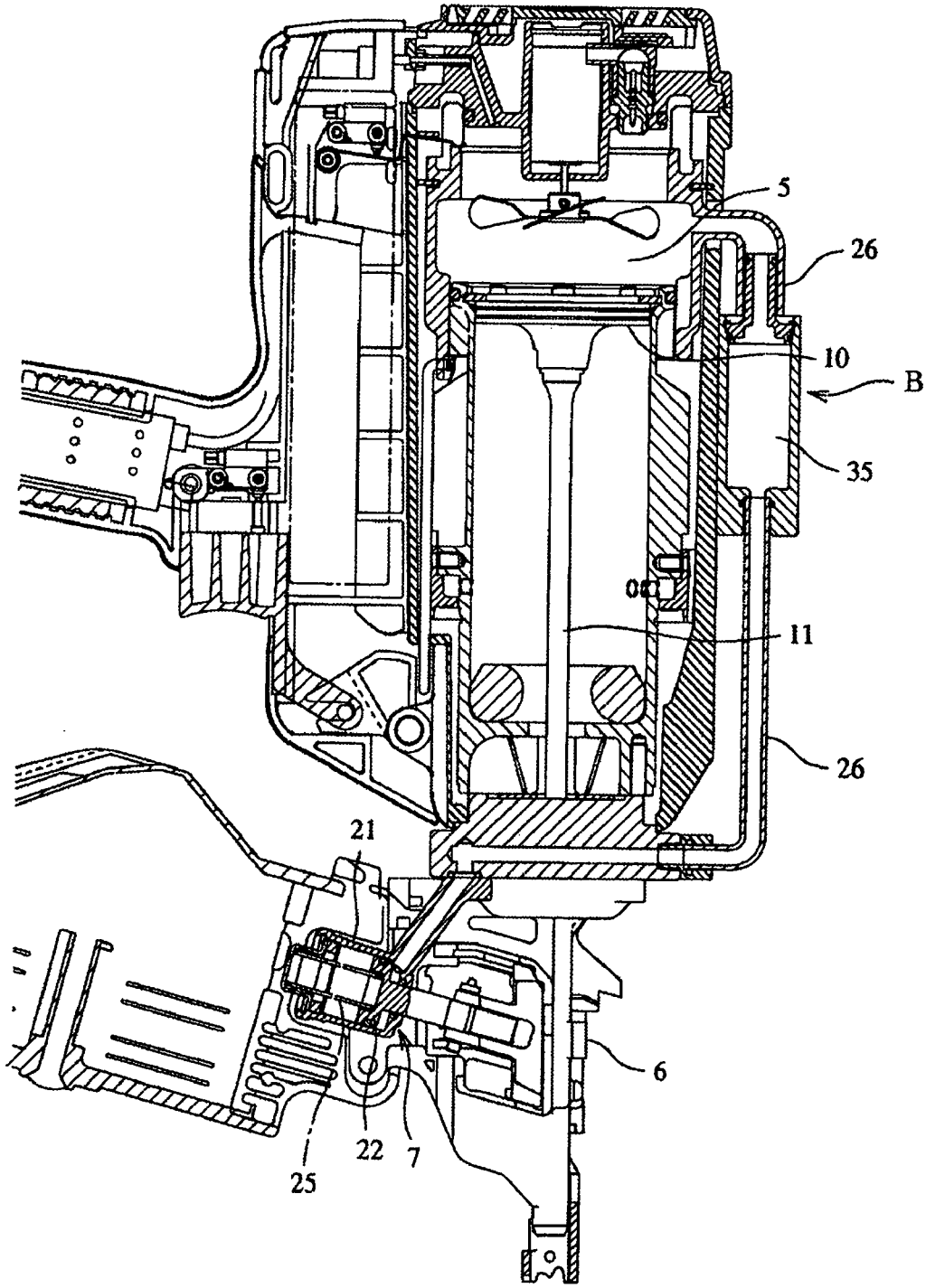
FIG. 9 is a longitudinal section view of a gas combustion type nail driving tool, showing it together with a delay chamber device.

Next, FIG. 9 shows an operation delay device used instead of the above-mentioned delay piston/cylinder device A. This operation delay device B is structured by a delay chamber device which includes a gas storing space portion 35 interposed between the combustion chamber 5 and piston/cylinder device 7. By the way, in FIG. 9, the parts of the operation delay device B, which are the same as those of the delay piston/cylinder device A, are given the same designations. A series of operations in FIG. 9 in the nail driving operation are also similar to FIGS. 3, 6, 7 and 8, and thus the description thereof is omitted here.

According to the present structure, in the nail driving operation, when the mixed gas within the combustion chamber is ignited and burned in the same manner as described above, the pressure of the combustion gas drives the striking piston 10 downward and the driver 11 strikes the leading nail supplied into the eject opening of the nose part 6, thereby driving it into the member to be nail-driven.

At the same time, the pressure of the combustion gas burned in the combustion chamber 5 is supplied from the gas conduit 26 to the feed piston/cylinder device 7. However, since there is formed the gas storing space portion 35 between the combustion chamber 5 and feed piston/cylinder device 7, the feed piston 22 cannot be actuated until the combustion gas is filled into the gas storing space portion 35 and the pressure within the gas storing space portion 35 is thereby raised up to a given level. When the pressure within the gas conduit 25 rises up to a given level, the combustion gas is supplied to the feed cylinder 21, so that the feed piston 22 is caused to move in the retreat direction.

In this manner, since the supply of the gas pressure to the feed cylinder 21 is not sufficient until the gas storing space portion 35 is filled with the combustion gas to thereby increase its pressure up to the given pressure, the operation of the feed piston 22 can be delayed by the time necessary for the above-mentioned combustion gas pressure to rise up to a level capable of retreating the feed piston 22. Therefore, the leading nail can be driven into the member to be nail-driven while it is held in a stable attitude.

When the nail driving operation is completed, a space existing within the combustion chamber 5 and upwardly of the striking piston 10 becomes negative in pressure, so that the striking piston 10 returns to its top dead center. Similarly, the gas conduit 26 also becomes negative in pressure and, therefore, the feed piston 22 is moved in the feed direction due to the urging force of the spring 25, so that a new leading nail is supplied into the nose part 6.

Figure 10:
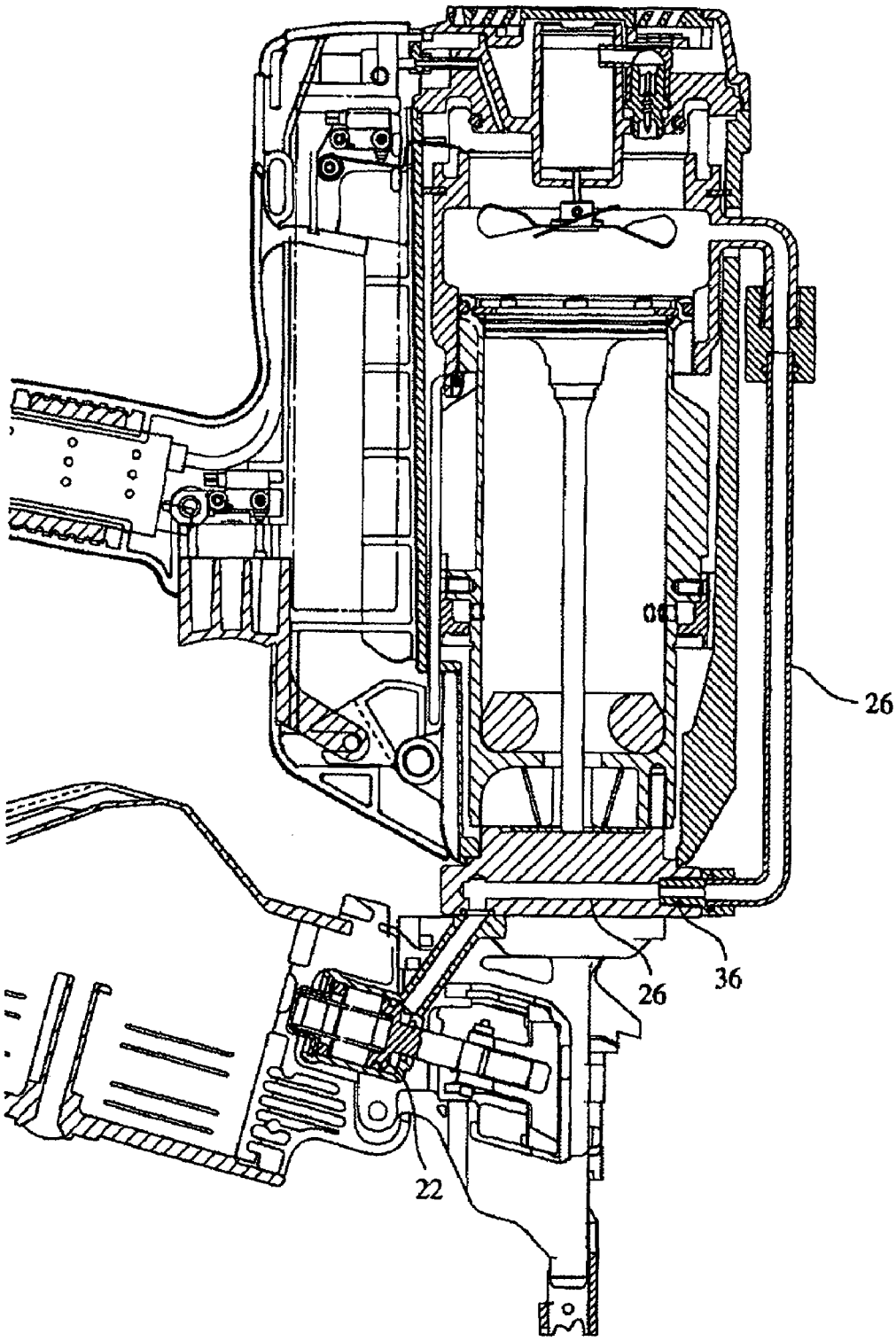
FIG. 10 is a longitudinal section view of a gas combustion type nail driving tool, showing it together with a delay drawing device.

Alternatively, the operation delay device may also be structured such that it includes in the gas conduit 26 such a drawing portion 36 for delay as shown in FIG. 10, instead of the gas storing space portion 35.

In this case, since it takes time for the combustion gas to pass through the drawing portion 36, the retreat operation of the feed piston 22 can be delayed by the time necessary for the pressure of the combustion gas, which has passed through the drawing portion 36, to rise up to a level capable of retreating the feed piston 22.

The position of formation of the drawing portion is not limited to the position shown in FIG. 10, but the drawing portion may be formed at any position in the gas conduit.

Figure 11:
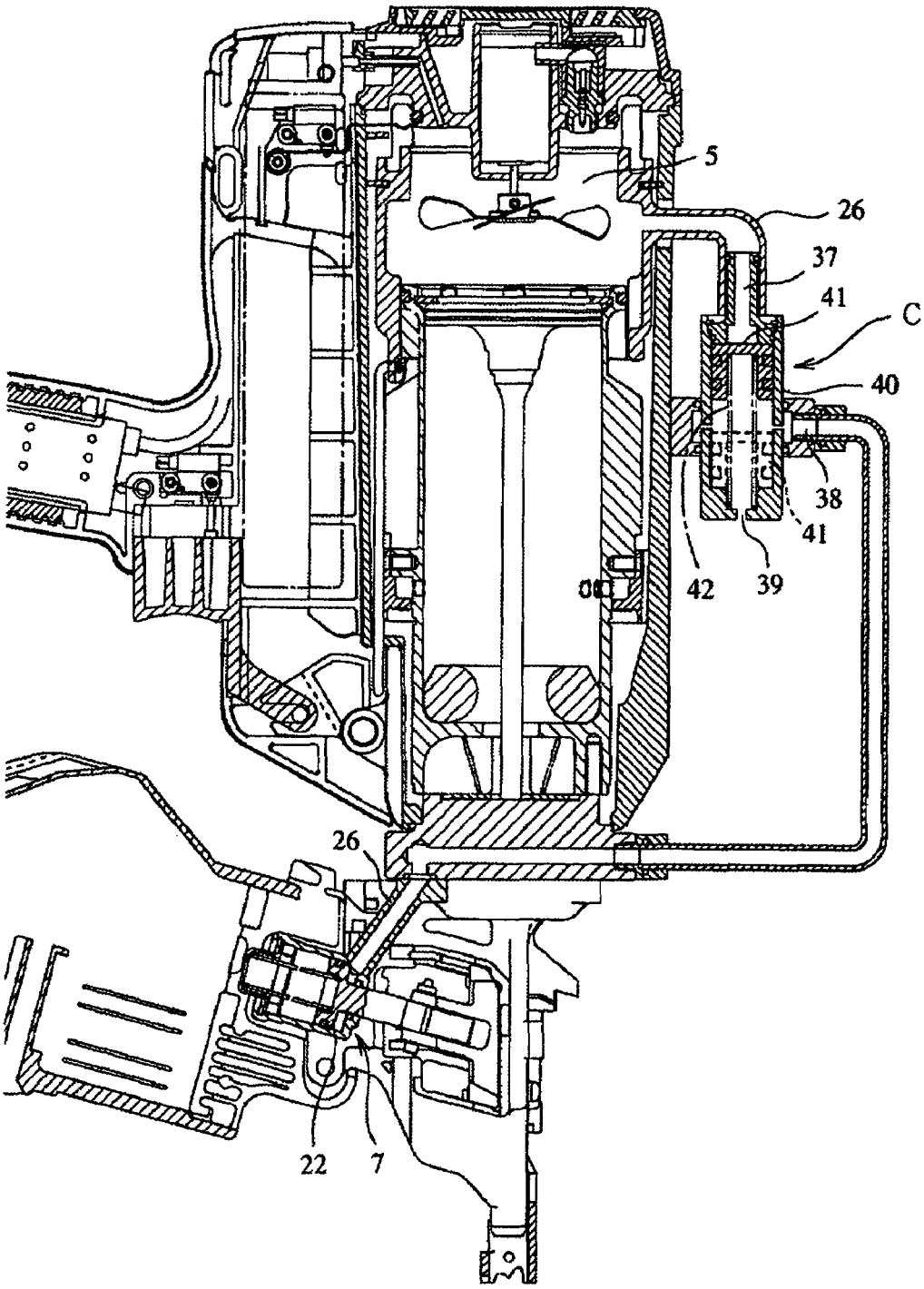
FIG. 11 is a longitudinal section view of a gas combustion type nail driving tool, showing it together with a delay timing valve device.

Next, FIG. 11 shows an operation delay device different from the above-mentioned operation delay device. This operation delay device is structured by a timing valve device C for delay which is disposed in the intermediate portion of the gas conduit 26. In FIG. 11, the parts of the timing valve device C, which are the same as those of the delay piston/cylinder device A, are given the same designations. A series of operations in FIG. 11 in the nail driving operation are also similar to FIGS. 3, 6, 7 and 8, and thus the description thereof is omitted here.

The present delaying timing valve device C is structured in the following manner. That is, the device C includes a valve cylinder 40 having openings 37 and 38 the upper ends and side portions of which are respectively connected to the gas conduit 26. A valve member 41 is slidably accommodated within the valve cylinder 40 and is normally energized by a spring 42 such that it is present at its top dead center. When the valve member 41 is present at the top dead center, the gas conduit 26 is closed, whereas, when the valve member 41 moves downward and, as shown by a broken line in FIG. 11, passes through the side portion opening 38, the gas conduit 26 is opened.

According to the present operation delay device, in the nail driving operation, when the mixed gas within the combustion chamber is ignited and burned in the same manner as described above, owning to the pressure of the combustion gas, the leading nail can be driven into the member to be nail-driven.

At the same time, the pressure of the combustion gas burned in the combustion chamber 5 is supplied from the gas conduit 26 to the feed piston/cylinder device 7. However, since there is formed the delaying timing valve device C between the combustion chamber 5 and feed piston/cylinder device 7, the pressure of the combustion gas is not supplied to the feed cylinder 21 during the time while the valve member 41 is moving from its top dead center to its opening position. And, when the pressure of the inside of the gas conduit 26 rises up to a given level, the feed piston 22 is moved in the retreat direction.

In this manner, since the operation of the feed piston 22 can be delayed by the time necessary for the valve member 41 to move and open the gas conduit 26 to thereby raise the pressure up to a given level. Therefore, the leading nail can be driven into the member to be nail-driven while it is held in a stable attitude.

When the nail driving operation is completed, not only because the striking piston 10 returns to its top dead center but also because the gas conduit 26 also becomes negative in pressure, the valve member 41 is caused to move to its top center, so that the gas existing within the gas conduit 26 on the feed cylinder 21 side is discharged to the atmosphere from the opening 39 formed in the lower end of the valve cylinder 40. Therefore, the feed piston 22 is caused to move in the nail feed direction due to the urging force of the spring, and a new leading nail is supplied into the nose part 6. By the way, as regards the magazine, there can be used not only the cylindrical-shaped magazine 3 but also a linear-shaped magazine which supplies a nail using a feed claw.

Although the invention has been described heretofore in detail and with reference to the specific embodiments thereof, it is obvious to a person skilled in the art that various changes and modifications are also possible without departing from the spirit and scope of the invention.

The present application is based on the Japanese Patent Application (Patent Application 2005-137773) filed on May 10, 2005 and thus the contents thereof are incorporated herein for reference.

INDUSTRIAL APPLICABILITY

The present invention can be applied to a fastener feed device used in a gas combustion type driving tool.

The invention claimed is:

1. A gas combustion type driving tool comprising:

a combustion chamber in which a mixed gas produced by stirring and mixing together combustible gas and air is combusted therein;

a striking piston to be driven by a combustion gas;

a driver connected to a lower surface side of the striking piston;

a nose part that slidingly guides the driver and drives out a fastener therefrom;

a feed claw engageable with and disengageable from connected fasteners accommodated within a magazine;

a feed piston/cylinder device that reciprocates the feed claw in a feed direction toward the nose part and in a retreat direction opposite to the feed direction;

a gas conduit that connects the combustion chamber and the feed piston/cylinder device; and an operation delay device disposed in the gas conduit for delaying a supply of a pressure of the combustion gas to the feed piston/cylinder device with respect to an operation of the striking piston.

2. The gas combustion type driving tool according to claim 1, further comprising:

a spring for normally urging the feed claw in the feed direction, wherein the feed claw is disposed on a feed piston in the feed piston/cylinder device and, when the combustion gas pressure is supplied to the feed piston/cylinder device, the feed piston is operated against an urging force of the spring by an action of the combustion gas and the feed claw moves in the retreat direction.

3. The gas combustion type driving tool according to claim 1, wherein the operation delay device comprises:

a delay cylinder disposed in an intermediate portion of the gas conduit such that one end of the delay cylinder is opened to the combustion chamber and the other end thereof is opened to the feed cylinder; and a delay piston slidingly movable within the delay cylinder by a pressure of the combustion gas, and when the delay piston is slidingly moved from one end of the delay cylinder to the other end thereof by the pressure of the combustion gas, air compressed within the delay cylinder is supplied from the other end of the delay cylinder to the feed cylinder.

4. The gas combustion type driving tool according to claim 1, wherein the operation delay device comprises a gas storing space portion formed in the gas conduit.

5. The gas combustion type driving tool according to claim 1, wherein the operation delay device comprises a drawing portion formed in the gas conduit.

6. The gas combustion type driving tool according to claim 1, wherein the operation delay device comprises a timing valve device including a valve member movable between one end of the timing valve device and the other end thereof, wherein the valve member closes the gas conduit when the valve member is present in one end of the timing valve device and the valve member opens the gas conduit when the valve member present in the other end of the timing valve.

* * * * *